United States Patent [19]

Salesky et al.

[11] Patent Number: 4,811,801

[45] Date of Patent: Mar. 14, 1989

[54] ROCK BITS AND INSERTS THEREFOR

[75] Inventors: William J. Salesky, Irvine, Calif.; Bruce L. Campbell, Pleasant Grove, Utah

[73] Assignee: Smith International, Inc., Irvine, Calif.

[21] Appl. No.: 169,232

[22] Filed: Mar. 16, 1988

[51] Int. Cl.[4] ..... C22C 29/08; E21B 10/52; E21B 10/56

[52] U.S. Cl. ..... 175/329; 51/309; 175/374; 175/410; 175/414

[58] Field of Search ..... 175/329, 293, 410, 414; 51/293, 309; 75/242; 76/108 A, 108 R

[56] References Cited

U.S. PATENT DOCUMENTS

| | | | |
|---|---|---|---|
| 4,108,692 | 8/1978 | Quinlan | 175/374 X |
| 4,109,737 | 8/1978 | Bovenkerk | 175/329 |
| 4,231,438 | 11/1980 | Garner et al. | 175/374 X |
| 4,339,009 | 7/1982 | Busby | 175/374 |
| 4,368,788 | 1/1983 | Drake | 175/374 |
| 4,372,404 | 2/1983 | Drake | 175/374 |
| 4,398,952 | 8/1983 | Drake | 419/18 |
| 4,411,672 | 10/1983 | Ishizuka | 51/309 |
| 4,525,178 | 6/1985 | Hall | 51/309 |
| 4,604,106 | 8/1986 | Hall et al. | 51/293 |
| 4,694,918 | 9/1987 | Hall | 175/410 X |
| 4,699,227 | 10/1987 | Wardley | 175/329 |
| 4,705,124 | 11/1987 | Abrahamson et al. | 175/410 |
| 4,722,405 | 2/1988 | Langford, Jr. | 175/374 |
| 4,756,373 | 7/1988 | Kane et al. | 175/329 |
| 4,764,255 | 8/1988 | Fischer et al. | 175/329 |

*Primary Examiner*—Stephen J. Novosad
*Attorney, Agent, or Firm*—Willian Brinks Olds Hofer Gilson & Lione Ltd.

[57] ABSTRACT

The present invention is a rock bit insert including a polycrystalline diamond surface on an insert body having a head portion made from a material with elasticity and thermal expansion properties advantageously tailored for use in three types of rock bits, as well as the three types of rock bits made with such inserts. The three types of bits are a roller cone rock bit adapted to be used with mud as the drilling fluid, a roller cone rock bit adapted to be used with air as the drilling fluid, and a percussion rock bit.

60 Claims, 2 Drawing Sheets

FIG. 5
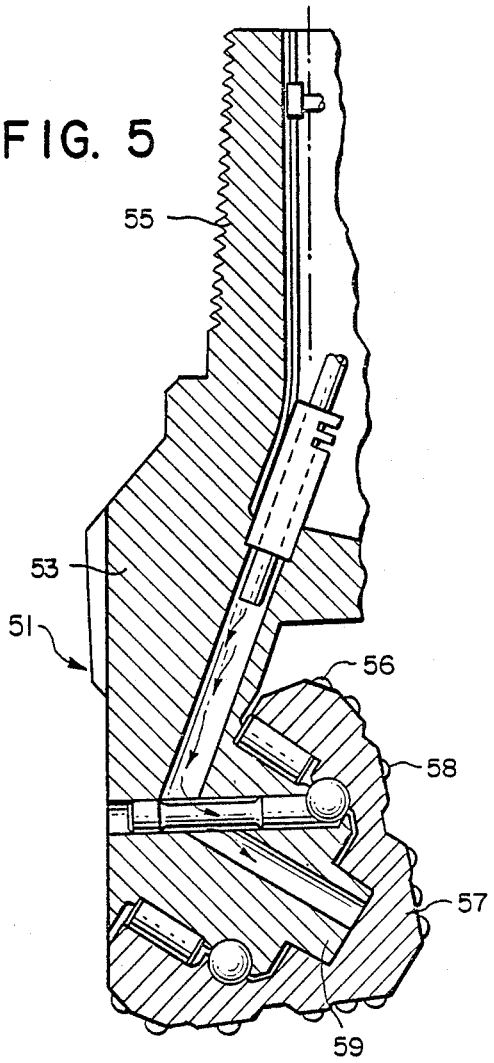
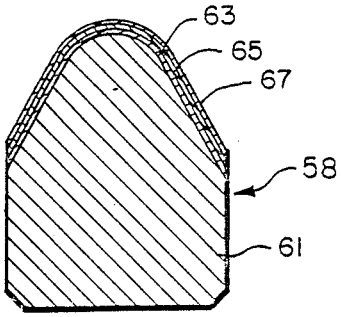
FIG. 6
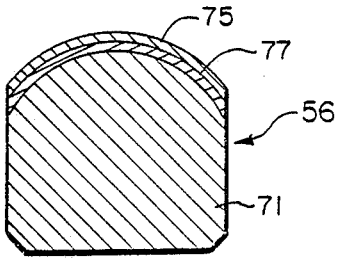
FIG. 7
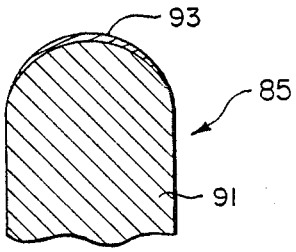
FIG. 9
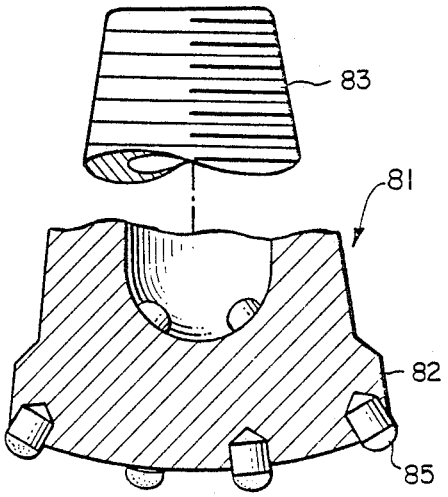
FIG. 8

ROCK BITS AND INSERTS THEREFOR

BACKGROUND OF THE INVENTION

The present invention relates to the field of rock bits and inserts therefor. More particularly, the invention relates to the field of roller cone type bits and percussion type bits which include inserts with a layer of polycrystalline diamond material on an insert body.

Roller cone rock bits are widely used for oil, gas, and geothermal drilling operations. In general, roller cone rock bits include a body connected to a drill string and typically three hollow cutter cones each mounted on journals on the bit body for rotation about an axis transverse to the axis of the drill bit. In use, the drill string and bit body are rotated in the bore hole and each cone is caused to rotate on its respective journal as the cone contacts the bottom of the bore hole being drilled.

Roller cone rock bits are generally divided into two categories: those used with mud as the drilling fluid, and those used with air as the drilling fluid. Although similar in the basic design, these two types of roller cone rock bits also have many design and manufacturing dissimilarities due to the differences in how the bits are used as well as the kinds of drilling equipment that is used with these two types of bits.

Typically, mud is used as the drilling fluid when drilling in formations that would tend to close in on the hole that has been drilled. That is, the weight of the mud is used to maintain the integrity of the borehole by balancing the geophysical forces surrounding the bore hole. As used herein, the term "mud" is intended to have a relatively broad meaning including conventional drilling mud, water, brine, and oils, as well as mixtures thereof.

On the other hand, air is typically used when drilling in fractured formations where the mud would have a tendency to seep into the formation, and when the borehole integrity is sufficiently stable.

Because typical drilling mud is relatively abrasive, roller cone rock bits used with mud generally include an elastomer seal to protect the bearings from the drilling mud. Also, mud bits are generally designed to last much longer and typically include precision journal bearings and a lubricant reservoir with pressure compensation means.

In contrast, air bits are generally designed for shorter run times and include unsealed unlubricated roller bearings. Accordingly, air bits are often used for geothermal drilling because the high temperatures encountered in this type of drilling would usually degrade the elastomer seals and lubricants used in the design of mud bits.

In addition, because the weight of the column of drilling mud above applies a greater pressure than a column of air on the bottom of the borehole, the interaction between the cutting inserts and the bottom of the hole is different for the inserts in a roller cone mud bit and the inserts in a roller cone air bit. In particular, the inserts of a roller cone mud bit are typically subjected to higher dynamic forces due to the influence of the mud column on the borehole bottom. Also, because the mud acts to balance the geophysical pressures surrounding the borehole, including the hole bottom, mud drilling typically has a slower rate of penetration than air drilling. Consequently, under identical weight on bit and rotational speed, inserts on mud bits will typically contact the rock formation more times to drill a given equivalent footage than in air drilling. Also, the inserts in mud bits typically extend further from the cone to achieve a more aggressive cutting action than is typically found with air bits.

In contrast, because the bottom of the borehole is underpressure balanced when drilling with air, the rock tends to explode on contact with the inserts. As a consequence of the explosive nature of air drilling, the peak load on each insert is lower than that with mud drilling.

Fixed head percussion rock bits, some times known as hammer bits, are another type of rock boring tool. Percussion rock bits are used most often in drilling blast holes for mining and construction. Other uses for fixed head percussion bits include gas, oil, and water drilling. The percussion bits include a body with one end for connecting to an air hammer. Hard metal inserts are embedded in the other end.

In operation, the air hammer moves the bit up and down rapidly. The percussion bit hammers the inserts against the rock being drilled, shattering it by repeated blows. A typical air hammer for percussion bits operates at about 2,000 blows per minute while being rotated at about 60 r.p.m. Compressed air pumped through the bit removes chips of fractured rock from the hole being drilled. Some percussion bits are driven by hydraulic action.

A significant improvement in the life expectancy of roller cone and percussion rock bits involves the use of cemented metal carbide inserts put into the roller cones for crushing rock on the bottom of the bore hole. Naturally, cemented metal carbide, such as cobalt cemented tungsten carbide, offered improved wear resistance over steel along with sufficient toughness to withstand the forces encountered during drilling. Since the advent of cemented metal carbide inserts in rock drilling, much effort has been devoted to improving both the wear resistance and toughness of the inserts. Wear resistance is important to prevent the insert from simply wearing away during drilling. Toughness is important to avoid inserts breaking off due to the high impact loads experienced in drilling.

A more recent development in roller cone rock bit inserts has been the use of a layer of polycrystalline diamond (PCD). In particular, inserts have been fabricated which include an insert body made of cobalt bonded tungsten carbide and a layer of polycrystalline diamond directly bonded to the protruding head portion of the insert body. The term polycrystalline diamond generally refers to the material produced by subjecting individual diamond crystals to sufficiently high pressure and high temperature that intercrystalline bonding occurs between adjacent diamond crystals. Naturally, PCD offers the advantage of greater wear resistance. However, because PCD is relatively brittle, some problems have been encountered due to chipping or cracking in the PCD layer.

U.S. Pat. No. 4,694,918, assigned to the assignee of the present invention, discloses roller cone rock bits and inserts therefor which inserts include a cemented metal carbide insert body, an outer layer of polycrystalline diamond, and at least one transition layer of a composite material. The composite material includes polycrystalline diamond and precemented metal carbide pieces. This transition layer between the outer layer of PCD and the head portion has been found to extend the life expectancy of PCD rock bit inserts by reducing the incidence of cracking an chipping.

SUMMARY OF THE INVENTION

Briefly stated, the present invention is a rock bit insert including a polycrystalline diamond surface on an insert body having a head portion made from a material with elasticity and thermal expansion properties advantageously tailored for use in three types of rock bits, as well as the three types of rock bits made with such inserts. The three types of bits are a roller cone rock bit adapted to be used with mud, a roller cone rock bit adapted to be used with air, and a percussion rock bit.

All of the inserts of the present invention include a body having a shaft portion for insertion into the rock bit and a head portion for protruding from the rock bit. A layer of polycrystalline diamond material is directly bonded to the head portion.

In the insert for a roller cone rock bit adapted to be used with mud as the drilling fluid, the material of the head portion has a Young's modulus of elasticity of between about 80 and about and about $89\times 10^6$ p.s.i, and a coefficient of thermal expansion of between about 2.9 and about $3.4\times 10^{-6}/°C$. Preferably, the head portion of the insert body is made from cobalt bonded tungsten carbide having a coercivity between about 85 and about 120 $O_e$ and a hardness of between about 88.1 and about 89.4 Ra.

The roller cone rock bit adapted to drill with mud as the drilling fluid includes a steel body, means at one end of the body for connecting the bit to a drill string, and means at the opposite end of the body for mounting at least one roller cone on the body for rotation around an axis transverse to the axis of the bit. The bit further includes at least one roller cone so mounted on the body for rolling on the bottom of a borehole being drilled. A plurality of inserts for crushing rock at the bottom of such a bore hole are included in the roller cone. At least a portion of these inserts include an insert body having a shaft portion for insertion into a rock bit and a head portion protruding from the rock bit. A layer of polycrystalline diamond material is directly bonded to the head portion of these inserts. The head portion of these inserts for a roller cone rock bit for use with mud comprises a material having a Young's modulus of elasticity of between about 80 and about and about $89\times 10^6$ p.s.i, and a coefficient of thermal expansion of between about 2.9 and about $3.4\times 10^{-6}/°C$. Preferably, the head portion of the insert body is made from cobalt bonded carbide having a coercivity between about 85 and about 120 $O_e$ and a hardness of between about 88.1 and about 89.4 Ra.

In the insert for a roller cone rock bit adapted to be used with air as the drilling fluid, the material of the head portion has a Young's modulus of elasticity of between about 90 and about $102\times 10^6$ p.s.i, and a coefficient of thermal expansion of between about 2.5 and $3.0\times 10^{-6}/°C$. Preferably, the head portion of the insert body is made from cobalt bonded carbide having a coercivity between about 120 and about 160 $O_e$ and a hardness of between about 89.5 and about 91.1 Ra.

The roller cone rock bit for use with air as the drilling fluid includes a steel body, means at one end of the body for connecting the bit to a drill string, and means at the opposite end of the body for mounting at least one roller cone on the body for rotation around an axis transverse to the axis of the bit. The bit further includes at least one roller cone so mounted on the body for rolling on the bottom of a borehole being drilled. A plurality of inserts for crushing rock at the bottom of such a borehole are included in the roller cone. At least a portion of these inserts include an insert body having a shaft portion for insertion into a rock bit and a head portion for protruding from the rock bit. A layer of polycrystalline diamond material is directly bonded to the head portion of these inserts. The head portion of these inserts for a roller cone rock bit for use with air as the drilling fluid comprises a material having a Young s modulus of elasticity of between about 90 and about $102\times 10^6$ p.s.i, and a coefficient of thermal expansion of between about 2.5 and $3.0\times 10^{-6}/°C$. Preferably, the head portion of the insert body is made from cobalt bonded carbide having a coercivity between about 120 and about 160 $O_e$ and a hardness of between about 89.5 and about 91.1 Ra.

In the insert for a percussion cone rock bit, the material of the head portion has a Young's modulus of elasticity of between about 90 and about $102\times 10^6$ p.s.i, and a coefficient of thermal expansion of between about 2.5 and $3.0\times 10^{-6}/°C$. Preferably, the head portion of the insert body is made from cobalt bonded carbide having a coercivity between about 120 and about 160 $O_e$ and a hardness of between about 89.5 and about 91.1 Ra.

The percussion rock bit includes a steel body, and means at one end of the body for connecting the bit to a drill string. A plurality of inserts are embedded within the other end of the steel body. At least a portion of these inserts include an insert body having a shaft portion for insertion into a rock bit and a head portion for protruding from the rock bit. A layer of polycrystalline diamond material is directly bonded to the head portion of these inserts. The head portion of these inserts for a percussion rock bit comprises a material having a Young's modulus of elasticity of between about 90 and about $102\times 10^6$ p.s.i, and a coefficient of thermal expansion of between about 2.5 and $3.0\times 10^{-6}/°C$. Preferably, the head portion of the insert body is made from cobalt bonded carbide having a coercivity between about 120 and about 160 $O_e$ and a hardness of between about 89.5 and about 91.1 Ra.

It has been found that: when the head portion of the inserts has been made from a material possessing the Young's modulus and coefficient of thermal expansion within the respective ranges; the inserts have a greater life expectancy than those wherein the head portion material does not fit within these ranges. In particular, it has been found that using the material within the respective ranges has reduced the incidence of cracking and chipping in the PCD layer. In addition, it has been found that the incidence of gross insert breakage has also been reduced.

It has also been discovered that the values for Young's modulus can be too high for practical use in the rock bits of the invention. In particular it has been found that: above the stated upper limits for the Young's modulus: the head portion of the insert body is too brittle to withstand the dynamic forces encountered during drilling. In other words, if the modulus of elasticity is too high, the inserts are prone to break off during drilling. Such breakage is particularly detrimental in that it not only reduces the penetration ability of the bit, but the broken pieces of the inserts can cause extensive damage to the rest of the rock bit.

It has further been discovered that the inventive ranges of Young's modulus and coefficient of thermal expansion for the inserts differ between those used in roller cone rock bits adapted for drilling with mud and those used in roller cone rock bits adapted for drilling with air. The difference in these ranges is believed to be caused by the differences between the forces acting on a mud bit insert and those acting on an air bit insert. The inventive ranges of Young's modulus and coefficient of thermal expansion for inserts used in percussion bits have been found to be identical to those for roller cone rock bits used with air.

These and other objects, advantages, and features of the present invention will be better understood upon review of the following detailed description of the preferred embodiments read in conjunction with the accompanying drawings.

BRIEF DESCRIPTION OF THE DRAWINGS

FIG. 5 is a partial cross-sectional view of roller cone rock bit adapted to drill with air.

FIG. 6 is a cross-sectional view of an insert for use in the rock bit of FIG. 5.

FIG. 7 is a cross-sectional view of a gage insert for use in the rock bit of FIG. 5.

FIG. 8 is a partial cross-sectional view of a percussion rock bit.

FIG. 9 is a cross-sectional view of an insert for use in the percussion rock bit of FIG. 7.

DETAILED DESCRIPTION OF THE PREFERRED EMBODIMENTS

Figure 1:
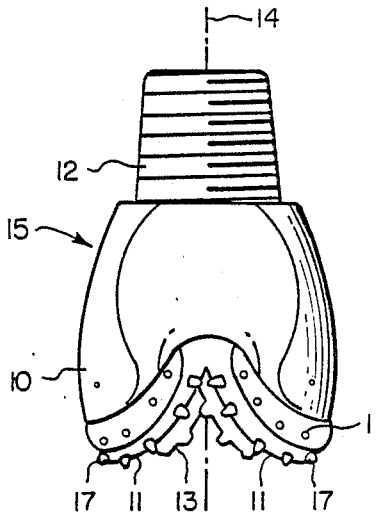
FIG. 1 is a side view of a roller cone rock bit adapted to drill with mud.

In accordance with the present invention, the selection of the elastic and thermal expansion properties of the material of the head portion of the insert body have been found to be important in reducing cracking and chipping in the PCD layer of a PCD coated rock bit insert.

While not wishing to be bound by any particular theory, it is currently believed that the present invention has proven successful according to the following theory. It is now believed that chipping and cracking in the PCD layer is related to some extent to a disparity between the properties of the PCD and the material directly beneath the PCD. Conventionally, this material has been cobalt bonded tungsten carbide.

One property which varies between the PCD and the cobalt bonded carbide is the modulus of elasticity. In particular, the Young's modulus of elasticity of diamond is typically between about 130 and about $150\times10^6$ p.s.i., while the Young's modulus of elasticity of cemented metal carbide, varies from about $75\times10^6$ p.s.i. for a 14 weight percent cobalt bonded tungsten carbide to about $99\times10^6$ for a 6 weight percent cobalt bonded tungsten carbide.

In view of this disparity, it is now theorized that some PCD cracking and chipping is due to the fact that the cemented carbide immediately below the PCD layer deflects under load beyond the elastic limit of the PCD layer. Consequently, enough strain is created in the PCD layer to cause cracking or chipping.

Another property for which exists a broad difference between PCD and cemented metal carbide is their coefficients of thermal expansion. Typically. PCD has a coefficient of thermal expansion of between about 2.29 and about $3.14\times10^{-6}/°C$. Depending on the grade of cemented carbide, the coefficient of thermal expansion varies between about 2.5 and about 6.0 $10^{-6}/°C$.

It is now believed that this disparity in thermal expansion can likewise cause cracking and chipping in the PCD layer. In particular, during formation of the PCD, the insert is subjected to temperatures typically between about 1300° and about 1500° C. As the insert cools the difference in thermal expansion between the two materials can set up strain between diamond containing layers which can in turn lead to early failure in service of the insert through cracking or chipping within the PCD layer.

In light of the above it has now been theorized that the incidence of cracking and chipping can be reduced by using a material in the head portion of the rock bit insert which material has a Young's modulus and a coefficient of thermal expansion within the stated ranges. In other words, reducing the disparity between the PCD material layer and the head portion below it is believed to be responsible for the extension in durability of the PCD material layer which extension has been observed in field testing.

In this specification and the appended claims, the modulus of elasticity is expressed as a Young's modulus with p.s.i, as the units. These values are determined by direct strain gage measurement of the slope of the stress-deflection curve. Alternatively, the Young's modulus can be measured by dynamic excitation, at ultrasonic frequency of longitudinal oscillations in a test bar, and ascertaining the resonance frequency of its natural oscillations. The elastic modulus of cemented metal carbides generally decreases with increasing cobalt content.

Preferably the material of the head portion is a cemented carbide, more preferably a cobalt bonded carbide. When cobalt bonded carbide is used, it has been found desirable to select a specific grade which has a coercivity and hardness with particular ranges.

It is noted that the term "coercivity," as used in the specification and appended claims, is intended to refer to the coercive force measuring the amount of reverse magnetism required to reduce the residual induction to zero after a sample is removed from a magnetic field where it was completely saturated. The units of this measurement are oersteds ($O_e$). The coercivity value is obtained by placing a test sample in a DC magnetic field and magnetizing to saturization. The field is reversed and the coercive field strength needed for demagnetization of the test sample is measured. In particular, the coercivity of the cemented metal carbides in the experiments for the present invention were determined with a Forster-Koerzimat. Model 1.095.

The coercivity of cemented carbides is directly related to the volume fraction of metal carbide, inclusions, porosity, eta phase of the carbide, internal stress and carbon content. In general, fine grained metal carbides with a low metal binder content have the highest coercivity values. On the other hand, large grain metal carbides with high metal binder content have the lowest coercivity values.

It is further noted that the term "hardness," as used in the specification and appended claims, is intended to refer to Rockwell "A" hardness which is expressed with the united "Ra". Rockwell "A" hardness is determined by ASTM B294-76.

In general, hardness of cemented carbides is related to grain size and binder content. Cemented carbides with large grain sizes have a lower hardness than fine grained materials. Also, as binder content increases, the hardness decreases.

These two properties, coercivity and hardness, are valuable in specifying different grades of metal bonded carbides for the following reasons. Coercivity is an easily measured property which reflects a combination of several variables within the cemented metal carbide. As noted above, coercivity is related to the volume fraction of metal carbide, inclusions, porosity, eta phase, and carbon content. Consequently, the coercivity value of a cemented metal carbide reveals much about the microstructure of the cemented metal carbide.

Hardness, on the other hand, is a measure of a macroscopic property of the cemented metal carbide. Although coercivity and hardness are related to some degree hardness is also related to the modulus of elasticity and is easily measured.

Figure 2:
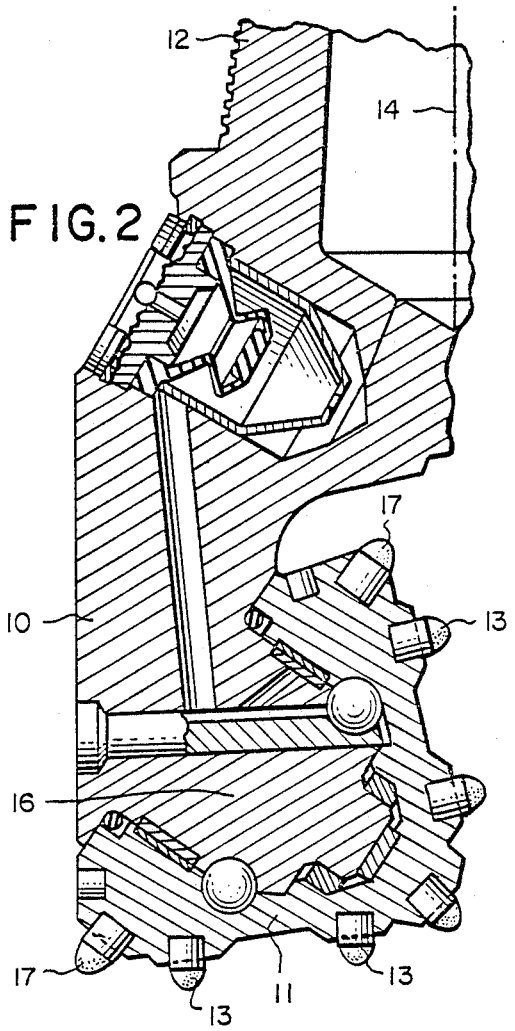
FIG. 2 is a partial cross-sectional view of such a rock bit.

Referring to the FIGS. 1 and 2, a roller cone rock bit 15 is shown which is adapted to be used with mud as the drilling fluid. The bit 15 includes a steel body 10 and a threaded end 12 for connection to a drill string (not shown). Three roller cones 11 are rotatably mounted on journals 16 on the bit body. Several inserts 13 are set in rows within recesses in each cone. As can be seen, the cones 11 are set at an angle transverse to the axis 14 of the bit. Consequently, as the bit is rotated the cones each rotate about their axis to bring the inserts 13 into contact with the bottom of the hole.

Another row of inserts 17 are set in a gage row of each cone. These inserts serve the important function of contacting the side of the hole in order to maintain the diameter, or "gage," of the hole. By virtue of their location on the cone, these gage row inserts 17 typically are subjected to more abrasive wear. It is known in the drilling industry that when the gage row inserts become too worn, the diameter of the hole becomes reduced as the rock bit continues to drill. This condition is highly detrimental because the next bit which is sent down the hole is required to ream out the diameter of the hole before it reaches the bottom of the hole. In addition, the life expectancy of the seal and bearing system are shortened when the gage of the hole is not maintained. For these reasons it is particularly advantageous to include the inserts of the present invention in the gage row of the roller cones.

Figure 3:
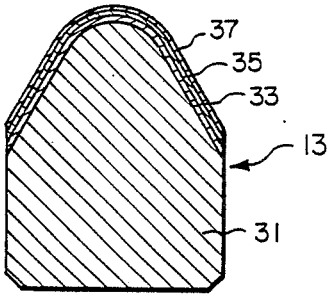
FIG. 3 is a cross-sectional view of an insert for use in the rock bit of FIG. 1.

FIG. 3 is a cross-section of one of the inserts 13 of the present invention. As can be seen, the insert 3 includes an insert body 31. This insert body includes a shaft portion which is inserted into the roller cone and a head portion which protrudes from the roller cone. The PCD is bonded directly to the head portion of the insert.

Figure 3A:
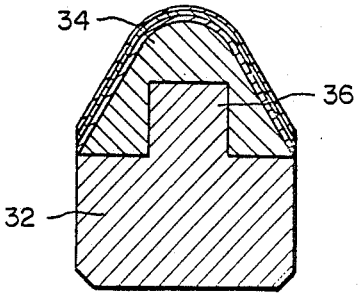
FIG. 3*a* is a cross-sectional view of an alternative insert for use in the rock bit of FIG. 1.

Preferably, the insert body is made in one piece, most preferably a unitary piece of cemented carbide. However, insert bodies can be manufactured in more than one piece. For example, it may be desirable to weld a cone or dome-shaped head portion onto a cylindrical shaft portion. Also, it may be desirable to attach a head portion with a non-planar interface with the shaft portion. For example. FIG. 3*a* shows a cone-shaped head portion 34 which is attached to a shaft portion 32 which includes a cylindrical portion 36 protruding into a recess in the head portion. Preferably, when the head portion is made from a different material, it will have a higher Young's modulus of elasticity than the material of the shaft portion. In view of these variations, it is noted that, as used in this specification and the appended claims, the term head portion refers to that portion of the insert body which is directly under the PCD layer.

The shape and size of the head portion can be varied by those of ordinary skill in the art depending on the type of formation to be drilled and other factors relating to the specific design of the roller cone rock bit. As shown here, the head portion of the cutting inserts 13 are shaped like a blunt cone. Other popular shapes are dome and chisel-shaped.

Preferably the PCD layer on the inserts is made according to the teachings of U.S. Pat. No. 4,694,918, the entire disclosure of which is incorporated herein by reference. According to this patent, the PCD layer is actually divided into layers itself. Preferably, the PCD layer includes at least one transition layer between the outer layer 37 and the head portion of the insert. Most preferably, the PCD layer includes two transition layers 33 and 35 as shown here. Each transition layer is comprised of polycrystalline diamond with pieces of precemented carbide dispersed therein. As taught in the above-named patent, inclusion of such transition layers has been found to increase the durability of the PCD in the outer layer.

U.S. Pat. No. 4,525,178 teaches the process for making this composite polycrystalline diamond. Accordingly, the entire disclosure of this patent is incorporated herein by reference. Also, U.S. Pat. No. 4,604,106 teaches the method of incorporating the composite polycrystalline diamond into transition layers. This patent is likewise incorporated herein in its entirety by reference.

Because the use of transition PCD layers is preferred for use with the present invention, it is noted that for convenience, the term "polycrystalline diamond material" is intended to refer herein to polycrystalline diamond as well as to composite polycrystalline diamond, i.e, polycrystalline diamond with pieces of precemented carbide dispersed therein. Also, when the term "PCD layer" is used, it is intended to include the outer layer of PCD and any transition layers of composite PCD material, if present.

According to the invention, the material of the head portion should have a Young's modulus between about 80 and about $89\times10^6$ p.s.i, and a coefficient of thermal expansion of between about 2.9 and $3.4\times10^{-6}/°C$. More preferably, the material of the head portion of the insert body should have a Young's modulus between about 83 and about $86\times10^6$ p.s.i. and a coefficient of thermal expansion between about 3.0 and about $3.4\times10^{-6}/°C$.

In the preferred embodiment depicted, the cobalt bonded tungsten carbide of the head portion of the insert in a roller cone rock bit for mud drilling as shown in FIGS. 1 and 2 should have a coercivity between about 85 and about 120 $O_e$ and a hardness of between about 88.1 and about 89.4 Ra. More preferably, the coercivity should be between about 95 and about 105 $O_e$; and the hardness should be between about 88.3 and about 89.1 Ra.

In the most preferred embodiment, the cemented metal carbide is cobalt bonded tungsten carbide made by Rodger's Tool Works (RTW) under the designation "367." The grade designation of this carbide has been previously known as TCM grade 411. The average grain size of the tungsten carbide is approximately 3 microns, and the cobalt content is about 11 percent by weight. The hardness of this grade of carbide is 88.8 Ra.

Alternatively, other grades of cobalt bonded tungsten carbide, such as TCM 410 or TCM 510 can be used. Also, other types of cemented metal carbides can be used. For example a tantalum bonded tungsten carbide can be used if it possess the requisite Young's modulus and coefficient of thermal expansion.

In still other alternative embodiments materials other than cemented metal carbides can be used. For example ceramic materials, and ceramic composites can be used so long as they possess the requisite elastic and thermal properties.

Most preferably, all of the cutting inserts 13 are made according to the present invention. However, in alternative embodiments, either all or some of the inner row inserts cutting the central portion of the borehole are conventional cemented metal carbide, either with or without a PCD layer.

Figure 4:
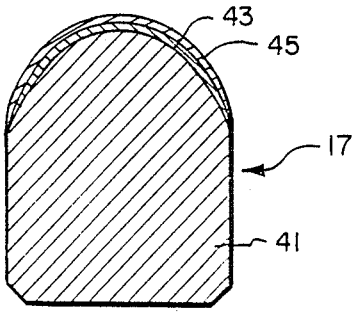
FIG. 4 is a cross-sectional view of a gage insert for use in the rock bit of FIG. 1.

FIG. 4 is a cross-sectional view of a gage insert 17 for the rock bit shown in FIGS. 1 and 2. As with the regular insert 13, the gage insert 17 includes an insert body 41 with a shaft portion and a head portion. As shown, however the shape of the head portion is different on the gage insert 17. In particular, the head portion of the presently preferred gage insert dome-shaped. The PCD layer of the gage insert 17 is divided into an outer layer of PCD 45 and a transition layer 43.

In accordance with this preferred embodiment, the material of the head portion of the insert body 41 is a cobalt bonded tungsten carbide having a coercivity between about 85 and about 120 $O_e$ and a hardness of between about 88.1 and about 89.4 Ra. More preferably, the coercivity should be between about 95 and about 105 $O_e$; and the hardness should be between about 88.3 and about 89.1 Ra.

The most preferred material for the head portion of the gage row is the same RTW 367 cobalt bonded tungsten carbide referred to above with the inner row inserts 13.

FIG. 5 is a partial cross-sectional view of a roller cone rock bit 51 for use with air as the drilling fluid. Similar to the mud bit shown in FIGS. 1 and 2, this air bit 51 includes a bit body 53 with an end 55 adapted to be threaded onto a drill string. A roller cone 57 is mounted on each leg 59 on the bit body. Several inserts 58 are set in rows in the roller cone 57. A row of gage inserts 56 is also included. As seen, the air bit 51 does not include seals or lubricating means as does the mud bit.

FIG. 6 is a cross-sectional view of the inserts 58 which are used in the air bit of FIG. 5. This insert is similar in construction to that shown in FIG. 3 with the exception that the properties of the material of the head portion are different. According to the invention, for the air bit, the material should have a Young's modulus of elasticity of between about 90 and about $102\times10^6$ p.s.i, and a coefficient of thermal expansion of between about 2.5 and $3.0\times10^{-6}/°C$. More preferably the material of the head portion of the insert body should have a Young's modulus between about 92 and about $99\times10^{-6}$ p.s.i, and a coefficient of thermal expansion between about 2.8 and about $3.0\times10^{-6}/°C$.

Preferably the head portion is made from a cobalt bonded tungsten carbide having a coercivity between about 120 and about 160 $O_e$ and a hardness of between about 89.5 and about 91.1 Ra. More preferably, the coercivity should be between about 140 and about 150 $O_e$; and the hardness should be between about 90.5 and about 91.1 Ra.

In the most preferred embodiment the cemented metal carbide for the inserts of the air bit is cobalt bonded tungsten carbide made by Rodger's Tool Works under the designation "374". The grade designation of this carbide is 406. The average grain size of the tungsten carbide is approximately 3 microns, and the cobalt content is about 6 percent by weight. The hardness of this grade of carbide is 90.8 Ra.

Alternatively, other grades of cobalt bonded tungsten carbide, such as 206 or 208 can be used. Also, other types of cemented metal carbides can be used. For example a tantalum bonded tungsten carbide can be used if it possess the requisite Young's modulus and coefficient of thermal expansion.

In still other alternative embodiments. materials other than cemented metal carbides can be used. For example ceramic materials, and ceramic composites can be used so long as they possess the requisite elastic and thermal properties.

FIG. 7 is a cross-sectional view of a gage insert 56 for the air bit shown in FIG. 5. This gage insert 56 is similar to that shown in FIG. 4 with the exception that the cemented metal carbide is the same as that shown with the insert of FIG. 6.

As with the mud bit, it is preferred that the cutting inserts 58 and the gage inserts are all made with the specified cemented metal carbide. However, in alternative embodiments, only the gage inserts 56 are so made.

FIG. 8 is a partial cross-sectional view of a percussion bit made according to the present invention. The bit 81 includes a steel body 82 with one end 83 adapted to thread onto a drill string. Several inserts 85 are embedded into the other end of the steel body.

FIG. 9 is a cross-sectional view of an inert 85 made according to the present invention. The insert includes an insert body 91 with a shaft portion and a head portion for protruding from the body of the percussion bit. Directly bonded to the head portion is a layer of PCD 93. Preferably, this layer of PCD is formed with at least one transition layer as described above.

According to the invention, for the percussion bit, the material of the head portion of the insert body should have a Young's modulus of elasticity of between about and about 90 and about $102\times10^6$ p.s.i, and a coefficient of thermal expansion of between about 2.5 and $3.0\times10^{-6}/°C$. More preferably, the material of the head portion of the insert body should have a Young's modulus between about 92 and about $99\times10^{-6}$ p.s.i, and a coefficient of thermal expansion between about 2.8 and about $3.0\times10^{-6}/°C$.

In accordance with the preferred embodiment of the present invention the material of the head portion is a cobalt bonded tungsten carbide having a coercivity between about 120 and about 160 $O_e$ and a hardness of between about 89.5 and about 91.1 Ra. More preferably, the coercivity should be between about 140 and about 150 $O_e$; and the hardness should be between about 90.5 and about 91.1 Ra.

In the most preferred embodiment, the cemented metal carbide for the inserts of the percussion rock bit is cobalt bonded tungsten carbide made by Rodger's Tool Works under the designation "374". The grade designation of this carbide is 406. The average grain size of the tungsten carbide is approximately 3 microns, and the cobalt content is about 6 percent by weight. The hardness of this grade of carbide is 90.8 Ra.

Alternatively, other grades of cobalt bonded tungsten carbide, such as 206 or 208 can be used. Also, other types of cemented metal carbides can also be used. For example a tantalum bonded tungsten carbide can be used if it possess the requisite Young's modulus and coefficient of thermal expansion.

In still other alternative embodiments. materials other than cemented metal carbides can be used. For example ceramic materials, and ceramic composites can be used so long as they possess the requisite elastic and thermal properties.

Preferably, all of the inserts in the percussion rock bit are made with cobalt bonded carbide having the stated stated properties.

There has thus been described rock bit inserts and three types of rock bits according to the present invention. Although much of the description has involved the use of cobalt bonded tungsten carbide as the material of the head portion, other cemented metal carbides, as well as other types of materials are within the scope of the present invention. Also, although much of the description has involved the use of single piece insert bodies, multiple piece insert bodies can also be used without departing from the scope of the present invention. Clearly, the scope of the present invention is not limited to this description of the preferred embodiments. All modifications which are within the ordinary skill in the art to make are considered to lie within the scope of the invention as defined by the appended claims.

I claim:

1. An insert for a roller cone rock bit adapted to drill with mud comprising:

an insert body having a shaft portion for insertion into a roller cone and a head portion for protruding from the roller cone; and a layer of polycrystalline diamond material directly bonded to the head portion;

wherein the head portion comprises a material having a Young's modulus of elasticity between about 80 and about $89\times10^6$ p.s.i, and a coefficient of thermal expansion of between about 2.9 and $3.4\times10-6$ /°C.

2. The insert of claim 1 wherein the material of the head portion has a Young's modulus of elasticity between about 83 and about $86\times10^6$ p.s.i.

3. The insert of claim 1 wherein the material of the head portion has a coefficient of thermal expansion between about 3.0 and about $3.4\times10^6$/°C.

4. The insert of claim 1 wherein the head portion comprises cemented carbide.

5. The insert of claim 4 wherein said cemented metal carbide is cobalt bonded tungsten carbide having a coercivity between about 85 and about 120 $O_e$ and a hardness of between about 88.1 and about 89.4 Ra.

6. The insert of claim 5 wherein the cobalt bonded carbide has a coercivity between about 95 and about 105 $O_e$.

7. The insert of claim 5 wherein the cobalt bonded carbide has a hardness of between about 88.3 and about 89.1 Ra.

8. The insert of claim 1 wherein the insert body is an integral piece of cemented carbide.

9. The insert of claim 1 wherein the insert body is made in at least two pieces.

10. The insert of claim 9 wherein the head portion is made from a material having a higher Young's modulus than that of the shaft portion of the insert body.

11. A roller cone rock bit adapted to drill with mud comprising:

a steel body:

means at one end of the body for connecting the bit to a drill string:

means at the opposite end of the body for mounting at least one roller cone on the body for rotation around an axis transverse to the axis of the bit:

at least one roller cone so mounted on the body for rolling on the bottom of a bore hole being drilled:

a plurality of inserts in said cone for crushing rock at the bottom of such a bore hole, at least a portion of said inserts comprising an insert body having a shaft portion for insertion into a rock bit and a head portion for protruding from the rock bit; and a layer of polycrystalline diamond material directly bonded to the head portion;

wherein the head portion comprises a material having a Young's modulus of elasticity between about 80 and about $89\times10^6$ p.s.i, and a coefficient of thermal expansion of between about 2.9 and $3.4\times10^{-6}$/°C.

12. The rock bit of claim 11 wherein the material of the head portion has a Young's modulus of elasticity between about 83 and about $86\times10^6$ p.s.i.

13. The rock bit of claim 11 wherein the material of the head portion has a coefficient of thermal expansion between about 3.0 and about $3.4\times10^{-6}$/°C.

14. The rock bit of claim 11 wherein the head portion comprises cemented carbide.

15. The rock bit of claim 14 wherein said cemented metal carbide is cobalt bonded tungsten carbide having a coercivity between about 85 and about 120 $O_e$ and a hardness of between about 88.1 and about 89.4 Ra.

16. The rock bit of claim 15 wherein the cobalt bonded carbide has a coercivity between about 95 and about 105 $O_e$.

17. The rock bit of claim 15 wherein the cobalt bonded carbide has a harness of between about 88.3 and about 89.1 Ra.

18. The rock bit of claim 11 wherein the insert body is an integral piece of cemented carbide.

19. The rock bit of claim 11 wherein the head portion is made from a material having a higher Young's modulus than that of the shaft portion of the insert body.

20. The rock bit of claim 11 wherein at least some of said inserts are embedded within a gage row on said roller cone.

21. An insert for a roller cone rock bit adapted to drill with air comprising:

an insert body having a shaft portion for insertion into a roller cone and a head portion for protruding from the roller cone; and a layer of polycrystalline diamond material directly bonded to the head portion;

wherein the head portion comprises a material having a Young's modulus of elasticity between about 90 and about $102\times10^6$ p.s.i, and a coefficient of thermal expansion of between about 2.5 and about $3.0\times10^{-6}$/°C.

22. The insert of claim 21 wherein the material of the head portion has a Young's modulus of elasticity between about 92 and about $99\times10^6$ p.s.i.

23. The insert of claim 21 wherein the material of the head portion has a coefficient of thermal expansion between about 2.8 and about $3.0\times10^{-6}$/°C.

24. The insert of claim 21 wherein the head portion comprises cemented carbide.

25. The insert of claim 24 wherein said cemented metal carbide is cobalt bonded tungsten carbide having a coercivity between about 120 and about 160 $O_e$ and a hardness of between about 89.5 and about 91.1 Ra.

26. The insert of claim 25 wherein the cobalt bonded carbide has a coercivity between about 140 and about 150 $O_e$.

27. The insert of claim 25 wherein the cobalt bonded carbide has a hardness of between about 90.5 and about 91.1 Ra.

28. The insert of claim 21 wherein the insert body is an integral piece of cemented carbide.

29. The insert of claim 21 wherein the insert body is made in at least two pieces.

30. The insert of claim 29 wherein the head portion is made from a material having a higher Young's modulus than that of the shaft portion of the insert body.

31. A roller cone rock bit adapted to drill with air comprising:

a steel body;

means at one end of the body for connecting the bit to a drill string:

means at the opposite end of the body for mounting at least one roller cone on the body for rotation around an axis transverse to the axis of the bit:

at least one roller cone so mounted on the body for rolling on the bottom of a bore hole being drilled:

a plurality of inserts in said cone for crushing rock at the bottom of such a bore hole, at least a portion of said inserts comprising:

an insert body having a shaft portion for insertion into a rock bit and a head portion for protruding from the rock bit: and a layer of polycrystalline diamond material directly bonded to the head portion;

wherein the head portion comprises a material having a Young's modulus of elasticity between about 90 and about $102\times10^6$ p.s.i, and a coefficient of thermal expansion of between about 2.5 and $3.0\times10^6/°C$.

32. The rock bit of claim 31 wherein the material of the head portion has a Young's modulus of elasticity between about 92 and about $99\times10^6$ p.s.i.

33. The rock bit of claim 31 wherein the material of the head portion has a coefficient of thermal expansion between about 2.8 and about $3.0\times10^{-6}/°C$.

34. The rock bit of claim 31 wherein the head portion comprises cemented carbide.

35. The rock bit of claim 34 wherein said cemented metal carbide is cobalt bonded tungsten carbide having a coercivity between about 120 and about and a hardness of between about 89.5 and about 91.1

36. The rock bit of claim 35 wherein the cobalt bonded carbide has a coercivity between about 140 and about 150 $O_e$.

37. The rock bit of claim 35 wherein the cobalt bonded carbide has a hardness of between about 90.5 and about 91.1 Ra.

38. The rock bit of claim 31 wherein the insert body is an integral piece of cemented carbide.

39. The rock bit of claim 31 wherein the head portion is made from a material having a higher Young's modulus than that of the shaft portion of the insert body.

40. The rock bit of claim 31 wherein at least some of said inserts are embedded within a gage row on said roller cone.

41. An insert for a percussion rock bit comprising:

an insert body having a shaft portion for insertion into the percussion rock bit and a head portion for protruding from the roller cone: and a layer of polycrystalline diamond material directly bonded to the head portion:

wherein the head portion comprises a material having a Young's modulus of elasticity between about 90 and about $102\times10^6$ p.s.i and a coefficient of thermal expansion of between about 2.5 and about $3.0\times10^{-6}/°C$.

42. The insert of claim 41 wherein the material of the head portion has a Young's modulus of elasticity between about 92 and about $99\times10^6$ p.s.i.

43. The insert of claim 41 wherein the material of the head portion has a coefficient of thermal expansion between about 2.8 and about $3.0\times10^{-6}/°C$.

44. The insert of claim 41 wherein the head portion comprises cemented carbide.

45. The insert of claim 44 wherein said cemented metal carbide is cobalt bonded tungsten carbide having a coercivity between about 120 and about 160 $O_e$ and a hardness of between about 89.5 and about 91.1 Ra.

46. The insert of claim 45 wherein the cobalt bonded carbide has a coercivity between about 140 and about 150 $O_e$.

47. The insert of claim 45 wherein the cobalt bonded carbide has a hardness of between about 90.5 and about 91.1 Ra.

48. The insert of claim 41 wherein the insert body is an integral piece of cemented carbide.

49. The insert of claim 41 wherein the insert body is made in at least two pieces.

50. The insert of claim 49 wherein the head portion is made from a material having a higher Young's modulus than that of the shaft portion of the insert body.

51. A percussion rock bit comprising:

a steel body:

means at one end of the steel body for connecting the bit to a drill string:

a plurality of inserts embedded within the other end of the steel body, at least a portion of the inserts comprising an insert body having a shaft portion for insertion into the steel body and a head portion for protruding from the steel body; and a layer of polycrystalline diamond material directly bonded to the head portion;

wherein the head portion comprises a material having a Young's modulus of elasticity between about 90 and about $102\times10^6$ p.s.i, and a coefficient of thermal expansion of between about 2.5 and $3.0\times10^{-6}/°C$.

52. The rock bit of claim 51 wherein the material of the head portion has a Young's modulus of elasticity between about 92 and about $99\times10^6$ p.s.i.

53. The rock bit of claim 51 wherein the material of the head portion has a coefficient of thermal expansion between about 2.8 and about $3.0\times10^{-6}/°C$.

54. The rock bit of claim 51 wherein the head portion comprises cemented carbide.

55. The rock bit of claim 54 wherein said cemented metal carbide is cobalt bonded tungsten carbide having a coercivity between about 120 and about 160 and a hardness of between about 89.5 and about 91.1 Ra.

56. The rock bit of claim 55 wherein the cobalt bonded carbide has a coercivity between about 140 and about 150 $O_e$.

57. The rock bit of claim 55 wherein the cobalt bonded carbide has a hardness of between about 90.5 and about 91.1 Ra.

58. The rock bit of claim 51 wherein the insert body is an integral piece of cemented carbide.

59. The rock bit of claim 51 wherein the head portion is made from a material having a higher Young's modulus than that of the shaft portion of the insert body.

60. The rock bit of claim 51 wherein at least some of said inserts are embedded within a gage row on said roller cone.

* * * * *

UNITED STATES PATENT AND TRADEMARK OFFICE

CERTIFICATE OF CORRECTION

PATENT NO. : 4,811,801

DATED : March 14, 1989

INVENTOR(S) : WILLIAM J. SALESKY et al.

It is certified that error appears in the above-identified patent and that said Letters Patent is hereby corrected as shown below:

In column 1, line 48, after "unsealed" please insert --,--.

In column 3, line 20, before "89" please delete the second occurrence of "and about" and delete "p.s.i," and substitute therefor --p.s.i.--.

In column 3, line 44, before "89" please delete the second occurrence of "and about" and delete "p.s.i," and substitute therefor --p.s.i.--.

In column 3, line 54, please delete "p.s.i," and substitute therefor --p.s.i.--.

In column 4, line 8, please delete "Young s" and substitute therefor --Young's--.

In column 4, line 9, please delete "p.s.i," and substitute therefor --p.s.i.--.

In column 4, line 17, please delete "p.s.i," and substitute therefor --p.s.i.--.

UNITED STATES PATENT AND TRADEMARK OFFICE

CERTIFICATE OF CORRECTION

PATENT NO. : 4,811,801

DATED : March 14, 1989

INVENTOR(S) : WILLIAM J. SALESKY et al.

It is certified that error appears in the above-identified patent and that said Letters Patent is hereby corrected as shown below:

In column 4, line 34, please delete "p.s.i," and substitute therefor --p.s.i.--.

In column 4, line 40, after "that" please delete ":".

In column 4, line 53, after "particular" please insert --,--.

In column 4, line 54, after "that" please delete ":".

In column 4, lines 54 and 55, after "modulus" please delete ":".

In column 6, line 27, please delete "p.s.i," and substitute therefor --p.s.i.--.

In column 7, line 63, after "example" please insert --,--.

In column 9, line 62, please delete "p.s.i," and substitute therefor --p.s.i.--.

In column 11, line 14, before "properties" please delete "stated".

UNITED STATES PATENT AND TRADEMARK OFFICE

CERTIFICATE OF CORRECTION

PATENT NO. :4,811,801

DATED :March 14, 1989

INVENTOR(S) :WILLIAM J. SALESKY et al.

It is certified that error appears in the above-identified patent and that said Letters Patent is hereby corrected as shown below:

Col. 13, claim 31, line 39 , please delete "p.s.i," and substitute therefor --p.s.i.--.

Col. 13, claim 35, line 52, after "about" please insert --160--; line 53, after "91.1" please insert --Ra.--.

Signed and Sealed this

Seventeenth Day of August, 1993

Bruce Lehman

*Attest:*

BRUCE LEHMAN

*Attesting Officer*

*Commissioner of Patents and Trademarks*